US012571384B2

(12) United States Patent
Hoibl

(10) Patent No.: US 12,571,384 B2
(45) Date of Patent: Mar. 10, 2026

(54) PUMP UNIT, STORAGE DEVICE EQUIPPED THEREWITH, AND METHOD FOR OPERATING THE STORAGE DEVICE

(71) Applicant: SCHEUGENPFLUG GMBH, Neustadt (DE)

(72) Inventor: Andreas Hoibl, Pentling (DE)

(73) Assignee: Scheugenpflug GmbH, Neustadt (DE)

( * ) Notice: Subject to any disclaimer, the term of this patent is extended or adjusted under 35 U.S.C. 154(b) by 0 days.

(21) Appl. No.: 18/441,302

(22) Filed: Feb. 14, 2024

(65) Prior Publication Data

US 2024/0271611 A1 Aug. 15, 2024

(30) Foreign Application Priority Data

Feb. 15, 2023 (DE) ..... 10 2023 103 599.1

(51) Int. Cl.
*F04B 43/073* (2006.01)

(52) U.S. Cl.
CPC ..... *F04B 43/073* (2013.01)

(58) Field of Classification Search
CPC ..... F04B 43/06; F04B 43/073; F04B 45/053; F04B 45/0536
See application file for complete search history.

(56) References Cited

U.S. PATENT DOCUMENTS

| | | | | |
|---|---|---|---|---|
| 10,738,769 | B2 * | 8/2020 | Lutz | F04B 43/0736 |
| 2009/0196771 | A1 * | 8/2009 | Juterbock | F04B 43/009 417/399 |
| 2013/0101445 | A1 | 4/2013 | Schlitze | |
| 2020/0102948 | A1 * | 4/2020 | Matsuo | H01L 21/67017 |

FOREIGN PATENT DOCUMENTS

| | | | |
|---|---|---|---|
| DE | 102010013108 | A1 | 9/2011 |
| DE | 102019128669 | A1 | 4/2021 |
| DE | 102020116815 | A1 * | 12/2021 |
| DE | 102021002178 | A1 | 10/2022 |
| EP | 2085614 | B1 | 3/2011 |
| WO | 2015078487 | A1 | 6/2015 |

* cited by examiner

*Primary Examiner* — Thomas Fink
(74) *Attorney, Agent, or Firm* — Kilpatrick Townsend & Stockton LLP

(57) ABSTRACT

In order to make the two pump units which are generally present in an emptying device for a storage container and which feed in alternating fashion as compact as possible on the one hand and subject to as little wear as possible on the other hand, both pump units are preferably equipped with a feed pump in the form of a diaphragm pump, which is driven by a hydraulically operated working cylinder unit.

23 Claims, 4 Drawing Sheets

Figure 1A:
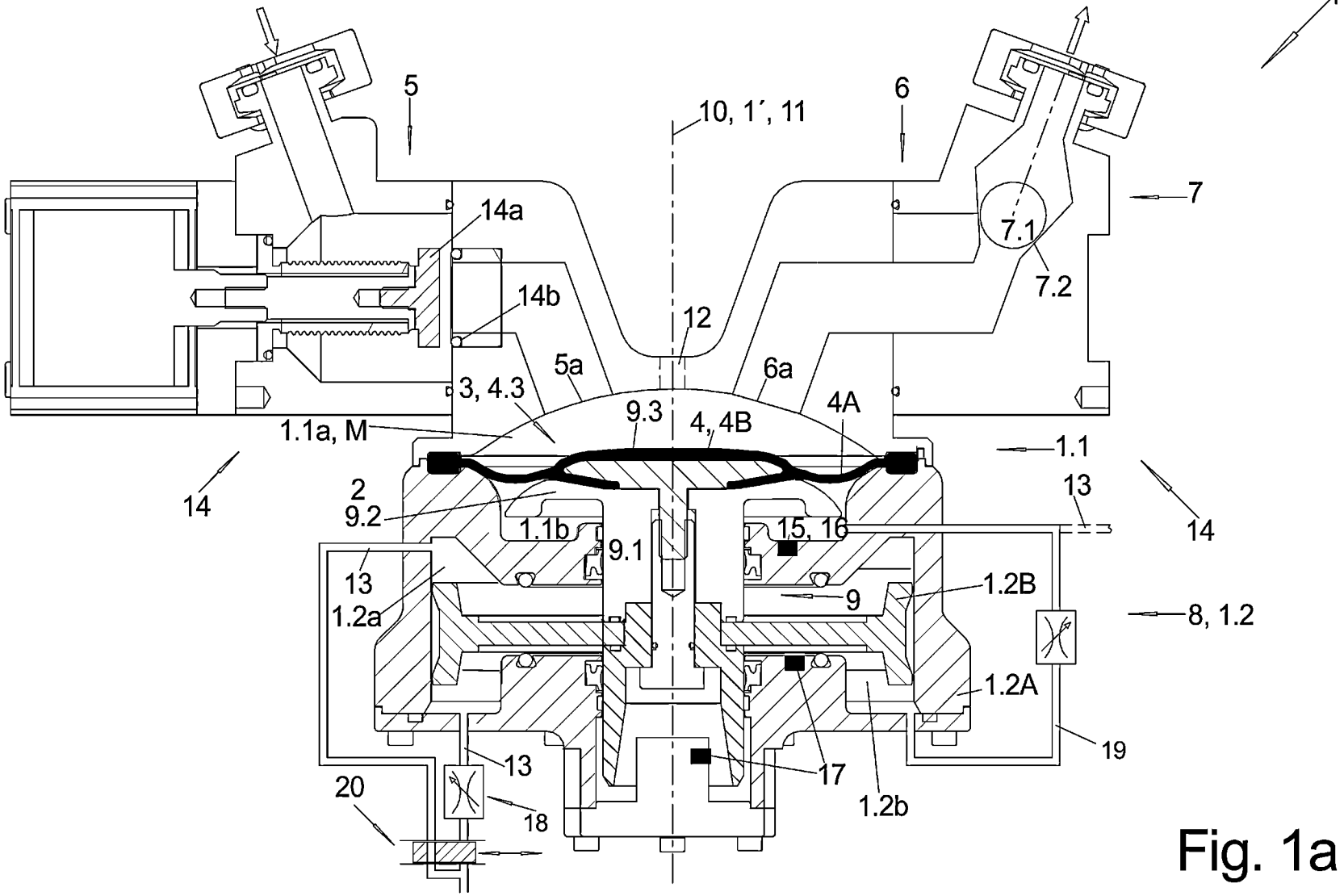

PUMP UNIT, STORAGE DEVICE EQUIPPED THEREWITH, AND METHOD FOR OPERATING THE STORAGE DEVICE

CROSS REFERENCE TO RELATED APPLICATION

This application claims priority to German Patent Application No. 10 2023 103 599.1, filed in Germany on Feb. 15, 2023, the entire contents of which are hereby incorporated herein by this reference.

DESCRIPTION

The invention relates to a pump unit for transporting liquid and above all viscous materials such as adhesives and resins, and to a storage device which comprises a storage container for such materials which is continuously refilled, usually automatically, even during operation, and from which these materials have to be pumped to a downstream consumer by means of such a pump.

BACKGROUND

In the industry, pasty materials in particular—e.g. potting compounds for moisture-proof encapsulation of electronic circuits, or adhesives for tightly bonding components together—are often applied to the corresponding components by means of automated dispensing processes via automatic dispensing machines as consumers, and must therefore be constantly supplied with the pasty material.

For this purpose, such a consumer is connected, via lines, to the storage device, in the usually pot-shaped storage container of which the corresponding material is located. A pump unit which effects the transportation of this viscous material is arranged in the line that leads from a usually low-lying removal opening of this storage container to the consumer.

One problem is that these materials often contain abrasive solids in finely dispersed form, for which reason certain pump designs in which one surface of a pump element slides tightly along a stationary surface, such as continuously operating worm pumps, are not suitable for this purpose, since the abrasive solids can get between these surfaces and cause rapid wear there.

Instead, pumps are frequently used in which the pump element comprises an elastic element which, although coming into connection with the abrasive material on one side, does not have to be moved tightly along another surface. The most common design is a diaphragm pump, which also has the advantage that it can be manufactured at low cost.

This is because transporting material to the consumer does not necessarily require a very precise volume to be maintained with each pump stroke, but simply a sufficient, preferably constant, pressure must always be present in the supply line to the consumer and thus in the outlet opening of the feed pump so that the consumer is sufficiently supplied with material at all times.

Since a diaphragm pump does not provide a continuous delivery stream, two diaphragm pumps are often operated alternatingly, are usually connected to the same storage container via separate connections and are controlled in such a way that one diaphragm pump is performing a working stroke, i.e. discharging material towards the consumer, while the other diaphragm pump is performing a return stroke, i.e. its pump chamber is being filled with new material from the storage container.

The necessary drive of the feed diaphragm transverse to its main plane can be realized by differently designed feed pump drives. It is known to use a further, pneumatically operated diaphragm unit or a likewise pneumatically operated working cylinder unit for this purpose, since in the event of leaks such pneumatic units do not result in contamination of the material.

However, in order to apply the high drive force necessary, especially in the case of very pasty materials, a pneumatically operated feed pump drive has to be dimensioned relatively large, which is disadvantageous due to the space available for such a pump unit often being very limited in practice.

The compressibility of the pressure medium in a pneumatically operated drive unit is also disadvantageous.

SUMMARY OF THE INVENTION a) Technical Object

It is therefore the object of the invention to provide a pump unit—especially for the storage device described—which is compact and inexpensive to manufacture.

In addition, it is the object of the invention to provide a method for operating such a pump unit and in particular its feed pump drive, which method makes a compact design possible.

b) Solution to the Object

This object is achieved by the features of claims 1, 14, and 17. Advantageous embodiments result from the subclaims.

A generic pump unit for pasty material comprises a feed pump which has a pump element which can move relative to the feed pump housing, as well as a feed pump drive in the form of a drive working cylinder for this pump element.

According to the invention, the drive working cylinder is a hydraulic cylinder, for which reason at least the working chamber on the rear side, facing away from the pump element, of the drive piston of the drive working cylinder has a hydraulic connection.

This is understood to be the working chamber that moves the pump element in the ejection direction when pressure is applied and the drive piston is correspondingly displaced, also referred to in the present application as the rear-side or rear working chamber of the drive working cylinder, even if, due to a reversal of direction in the operative connection between the drive working cylinder and pump element, this working chamber is not located on the rear side of the drive piston facing away from the pump element from a geometric point of view.

On the one hand, this allows the effective surface of the hydraulic piston in the hydraulic cylinder to be kept small, since high pressures can be applied more easily by means of a hydraulic medium than by means of a gas, so that even the movement of the feed diaphragm is thus faster.

Furthermore, due to the incompressibility of the hydraulic medium, the movement path of the hydraulic piston of the pump drive and thus of the pump element, in particular its movement path in relation to the elapsed movement time, can be controlled more precisely than in the case of a pneumatic cylinder.

Preferably, the other working chamber, i.e. the front-side or front working chamber, of the drive working cylinder also has a connection for a pressure medium, be it a hydraulic medium or compressed air, so that the pump element can also be pressurized in the direction of the drawing of material in the feed pump, which accelerates the operation of the pump unit.

In particular, the drive working cylinder, preferably its piston rod, is mechanically fixedly coupled to the elastic element, in particular to the feed diaphragm, via a drive plunger.

Furthermore, the drive chamber of the feed pump facing away from the feed chamber in relation to the pump element can also have a hydraulic connection, so that in particular the same pressure can be applied there as in one of the two working chambers of the hydraulic pump itself, which additionally increases the acceleration and speed of the pump element.

This can be realized in a simple manner by a connecting line, which can be closed in particular by a valve, between the drive chamber of the feed pump and the at least one working chamber of the hydraulic cylinder.

A pressure sensor is preferably present at least in the working chamber of the working cylinder unit that can be charged with hydraulic medium, in order to be able to monitor the correct application of pressure medium to the working piston.

The pump element preferably comprises at least one elastic element, the elastic element preferably itself being the pump element, which during pumping operation is only in contact on one side with the material to be conveyed.

This elastic element should be a substantially flat diaphragm, which means that the extension of the diaphragm transverse, in particular perpendicular, to its main plane, in which it has its greatest extension, is at most 50%, better at most 40%, better at most 30%, better at most 20% of the maximum extension along its main plane.

Such a pump unit preferably also comprises a controller, usually an electronic controller, which controls at least all moving parts of the pump unit.

There are different forms of pump that comprise an elastic element as part of the pump element:

On the one hand, a bellows pump in which a pump piston is axially movable in a pump housing but the pump piston does not lie tightly against the cylinder wall with its outer circumference—whether via seals or piston rings—and move along this wall, but rather ends radially at a distance from the inner circumferential wall of the cylinder, wherein a sleeve-shaped, elastic bag, usually a bellows, is tightly attached with its one annular end edge to the outer circumference of the pump piston and with its other annular end edge to the pump housing.

Another design is a so-called diaphragm pump, in which an elastic, approximately plate-shaped diaphragm divides the interior of the pump housing—usually formed by two bell-shaped or cup-shaped housing parts with the open sides tightly fastened against each other—into a feed chamber and a working chamber, and is tightly fastened around its outer edge against the pump housing, for example between the two housing halves which are pressed against each other, usually screwed together.

By moving the diaphragm transversely to its main plane the feed chamber is alternately enlarged and made smaller, so that, by means of corresponding inlet and outlet valves, when the volume of the feed chamber, which at its maximum volume is filled with the material, is reduced by means of the diaphragm the material contained therein is pressed out through an outlet opening and is conveyed to the consumer, and when its volume is increased it is filled with material through the inlet opening.

The diaphragm pump design in particular, which is at the foreground of the present invention, is very simple and inexpensive to manufacture, since the individual components for this purpose are inexpensive to manufacture due to having only a few and, moreover, flat fitting surfaces.

In addition to the continuous main part of the diaphragm that separates the interior of the pump housing, the diaphragm preferably has a concentric, annular diaphragm extension on the drive side of the diaphragm, which extension is in particular made in one piece with the main part of the diaphragm. The radially outer edge of the annular diaphragm extension merges into the continuous part of the diaphragm, and its free, radially inner edge projects therefrom and is resilient in the direction of movement in relation to the continuous main part of the diaphragm.

The diaphragm extension is preferably arranged in a circumferentially annular fashion between the outer edge and the central region of the main part of the diaphragm.

A mushroom-shaped diaphragm support is located as a tension plate with the outer circumferential edge region of its head in the intermediate space between the continuous and the annular part of the diaphragm, and the stem of the mushroom shape extends away from the diaphragm through the central opening of the annular extension and is detachably connected, for example screwed, to the piston rod or directly to the piston of the hydraulic cylinder.

As a result, the diaphragm can be not only pushed but also pulled. The head of the diaphragm support is either seated only with a positive fit between the two parts of the diaphragm or is firmly connected to one or both of these parts, for example glued.

The effective surface that can be acted on of the drive piston of the working cylinder is preferably hardly larger, at most 20%, better at most only 10% larger, preferably equal to or at least 10% smaller, better at least 20% smaller, than the effective surface of the diaphragm of the diaphragm feed pump.

As a result, low pressures of the drive medium already suffice for operating the hydraulic drive working cylinder.

The drive chamber of the feed pump can also have a pressure connection and negative pressure can therefore, for example, be applied, preferably the same negative pressure that usually prevails in the storage container to be emptied.

This ensures that during the return stroke the diaphragm can be actively moved into the fully retracted filling position and that the diaphragm is not sucked in the direction of the inlet opening in the region of the inlet opening by a pressure difference prevailing there.

In order to be able to further increase the force with which the ejection takes place, it can also be provided that the drive chamber of the diaphragm pump, i.e. the feed pump, can also be acted upon by hydraulic medium and therefore has a hydraulic connection, in particular with the same pressure, or a pressure adjustable in relation thereto, as the working chamber of the hydraulic cylinder facing away from the feed pump, for which purpose there is then preferably a connecting line in between, in particular with a proportional valve in its course.

A position sensor is preferably provided to monitor the position of the feed pump drive or of the diaphragm in the axial direction, at least with regard to reaching the two end positions, preferably over their entire movement path.

A heating device, in particular in the form of electrical heating coils for a heated liquid heating medium or electrical lines, can also be provided upstream of the feed pump housing or within the feed pump housing in order to heat the material to be pumped and thus to thin it and make it more pumpable. Conversely, in individual applications, a cooling device may also be necessary which can comprise pipes for a cooled liquid coolant.

A leakage sensor, in particular a liquid sensor, is preferably arranged in the drive chamber of the feed pump, which detects material entering the drive chamber in the event of a leak, such as a tear in the diaphragm, and reports this to the controller, which thereupon emits at least one alarm signal. The use of a liquid sensor only makes sense when no hydraulic medium is provided in the drive chamber.

With regard to the storage device, which comprises at least one pump unit in addition to the storage container for the material to be conveyed, this object is achieved in that the pump unit is designed according to one of the preceding claims.

Here the storage device preferably comprises two such pump units, which can be driven, for example, counter-synchronously in order to ensure a quasi-continuous feed of the material into the common outlet line to the consumer.

However, the two pump units can preferably be controlled independently of each other, so that temporal overlaps between the return stroke of the one pump unit and the working stroke of the other pump unit, or a time interval between them, can also be achieved.

The tightly sealed storage container is preferably pressurized with a negative pressure to prevent air from mixing into the material in the storage container, especially if this container is equipped with a mixer.

The air chamber of the storage container is preferably then connected to the drive chamber of the feed pump—of course, only if the drive chamber is not connected to the hydraulic circuit—and this connection can be selectively opened and closed via a valve.

As a result, the same pressure prevails on both sides of the diaphragm in the feed pump, so that when the feed pump is being filled, the diaphragm is brought into the optimally close end position to the housing on the drive side and a maximum pump volume is achieved, even without having hydraulic medium on the drive side of the diaphragm or of the bellows, which, in the event of a tear in the elastic element, such as the diaphragm, results in a long downtime and high resulting costs due to the mixing of hydraulic medium and the material to be pumped.

With regard to the method for operating such a pump unit, in particular in such a storage device, the existing object is achieved by the feed pump drive in the form of a working cylinder unit being operated at least partially hydraulically.

The working piston is hydraulically acted upon at least in the direction in which the working cylinder unit moves the pump element in the ejection direction.

In the opposite direction, it can be acted on hydraulically or pneumatically, in each case alternating with being acted on in the ejection direction.

The application of a pressure medium even in the opposite direction increases the speed of movement of the pump element.

The axial position of a moving, to be monitored element of the pump unit, in particular

- of the piston of the hydraulic drive working cylinder and/or
- of the diaphragm, in particular of a defined point or region of the diaphragm,
- is preferably determined directly or indirectly, in particular is determined over the entire movement path, and the controller of the pump unit uses the position signal in order to provide a drive pressure that is defined for each axial position, in particular a constant drive pressure, at the drive working cylinder.

In most cases, the drive chamber of the diaphragm feed pump is also pressurized with negative pressure, in particular with the same negative pressure as the air chamber of the storage container, in particular as soon as the ejection movement of the drive plunger has ended, or permanently, in order to avoid deformations of the diaphragm in the direction of the material inlet opening caused by negative pressure on one side.

The inlet valve is preferably closed as soon as the position sensor signals that the end position of the diaphragm of the feed pump has been reached in the filling position, in order to ensure that no material can be pushed back into the storage container during the subsequent ejection.

If a leakage sensor, in particular a liquid sensor, is present, the controller can report the entry of liquid into the drive chamber when a corresponding signal is received and can emit an alarm signal so that the diaphragm pump is repaired, in particular the diaphragm is replaced, or the entire pump unit is replaced by a new one.

This minimizes the duration of an interruption in operation of the storage device, especially as only the actively controllable inlet valve of the corresponding pump unit needs to be closed for this, and the pump unit can be disconnected from its connections and removed after a final feed stroke has been completed.

C) EMBODIMENTS

Figure 1B:
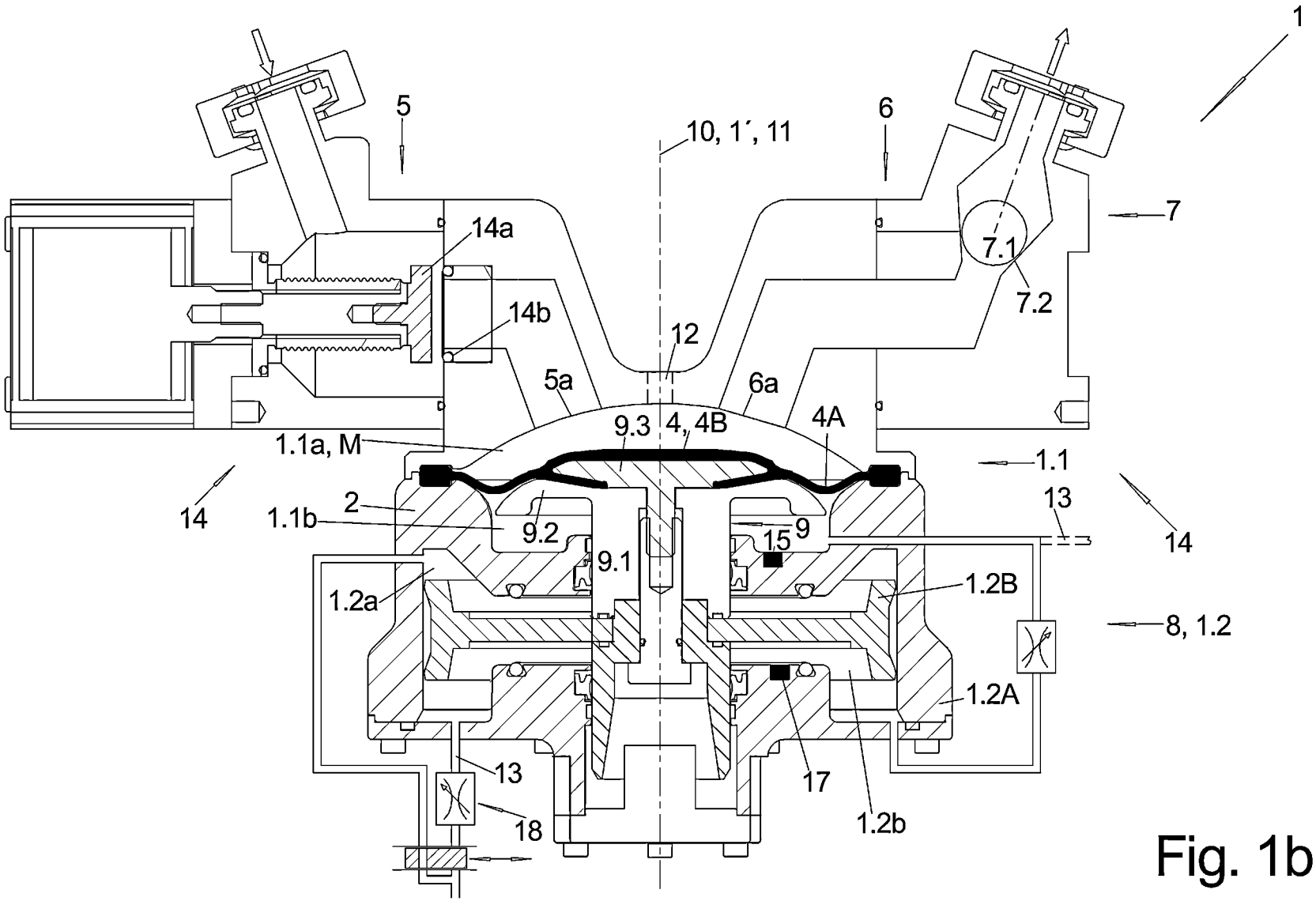
Figure 1C:
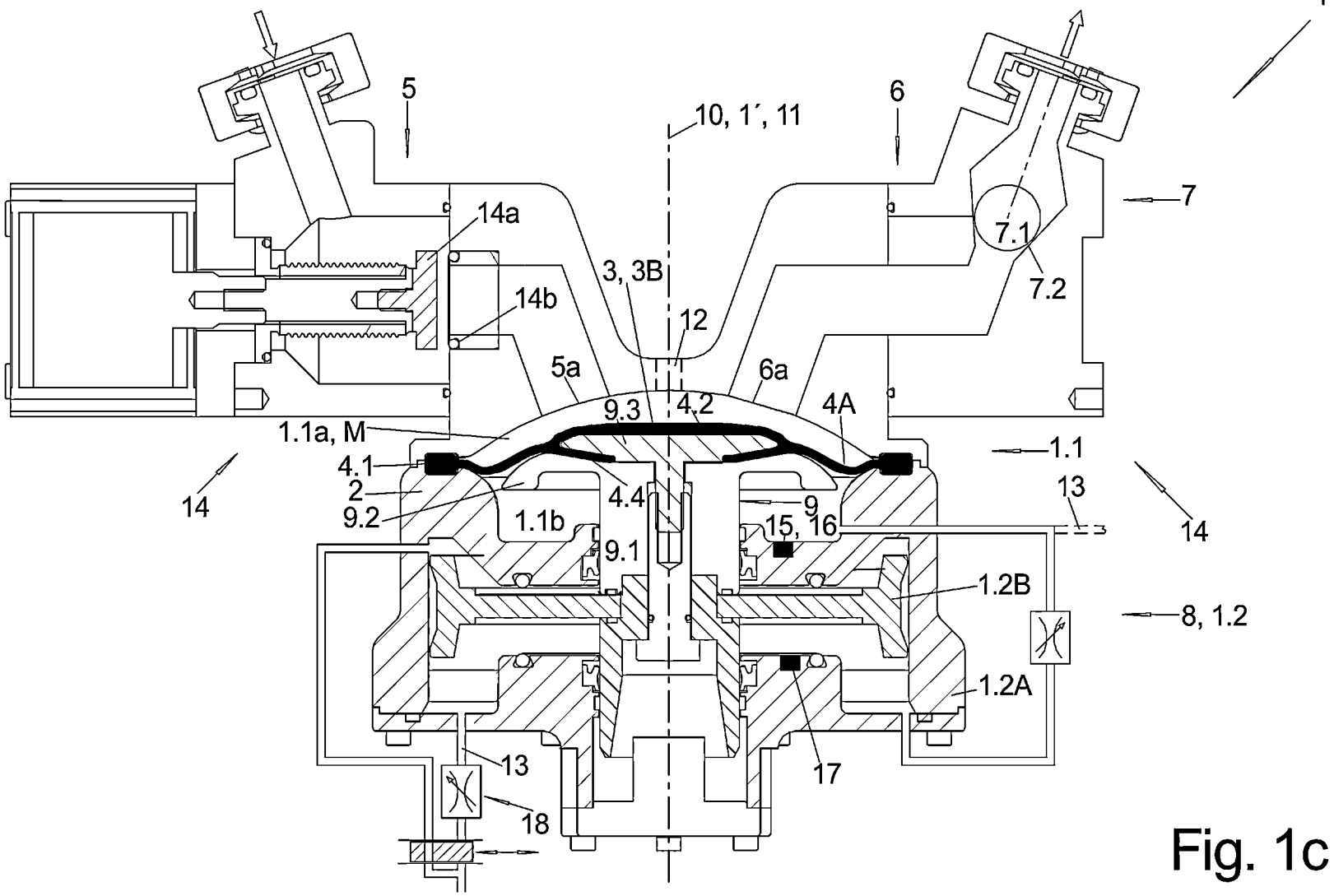
Figure 2:
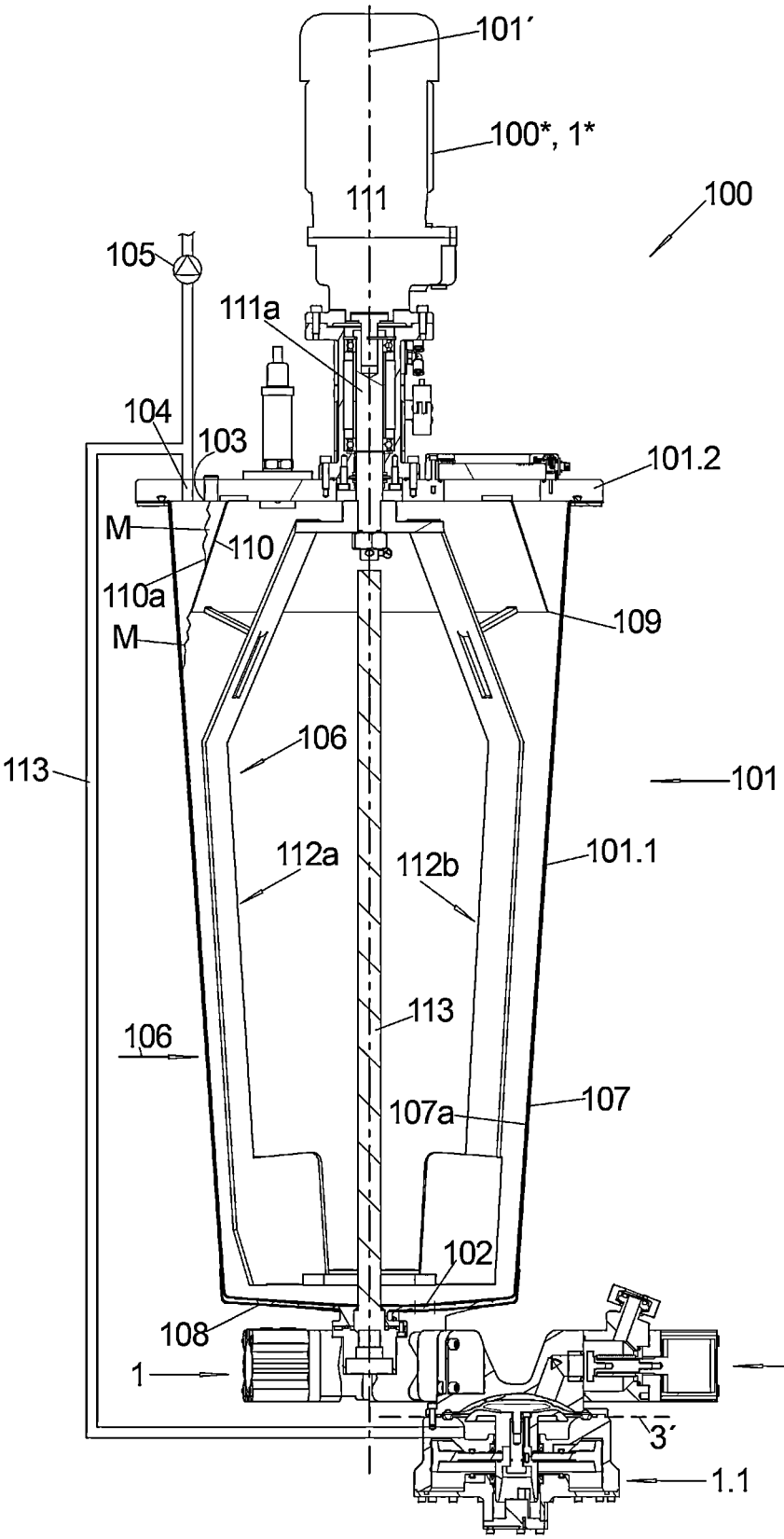

Embodiments in accordance with the invention are described in more detail below by way of example. In the figures:

FIG. 1*b*: shows the pump unit in the center position (normal position),

FIG. 1*a*: shows the pump unit at the end of the filling stroke,

FIG. 1*c*: shows the pump unit at the end of the feed stroke,

FIG. 2: shows the entire storage device in vertical section with at least one pump unit.

The structure of a pump unit 1 according to the invention can best be seen in the sectional view in FIG. 1:

The pump unit 1 consists of a feed pump 1.1 in the form of a diaphragm pump, and a diaphragm 4 serving as the pump element 3 in the direction of movement 10, a feed pump drive 8 coaxially upstream of this diaphragm pump and connected to it in the form of a hydraulically operated working cylinder unit 1.2, i.e. a hydraulic cylinder 8.

Both the diaphragm 4 and the drive piston 1.2*a* coaxial thereto of the working cylinder unit 1.2 are rotationally symmetrical, viewed in the direction of the longitudinal central axis 1', which is perpendicular to the main plane 3', which here runs approximately horizontally, of the diaphragm 4 and of the drive piston 1.2*a* and at the same time is the direction of movement of the drive piston 1.2*a*, and in the installed state is often identical to the vertical 11.

The feed chamber 1.1*a* has an inlet opening 5*a* in the upper region, via which the material M can flow into the feed chamber 1.1*a* when the inlet valve 5 arranged in or at the inlet opening 5*a* is open, the outlet valve 6 then generally being closed.

In the upper region, the feed chamber 1.1*a* also has an outlet opening 6*a*, in or at which an outlet valve 6 is arranged, so that material M can flow out of this outlet opening 6*a* when this outlet valve 6 is open, the inlet valve 5 then generally being closed.

In this way, the feed chamber 1.1*a* is filled with material M when the diaphragm 4 moves away from the inlet opening 5*a* (filling stroke) and the material M in the feed chamber 1.1*a* is ejected into the outlet opening 6*a* when the diaphragm 4 moves towards the outlet opening 6*a* (feed stroke), generally being controlled by a controller 1*.

The feed pump 1.1 is driven, i.e. its diaphragm 4 is moved alternately back and forth transversely to its main plane 4', by means of a drive plunger 9 engaging in the center of the diaphragm 4 on its rear side, i.e. from the drive chamber 1.1*b*.

The feed pump drive 8 in the form of a hydraulic cylinder 8 comprises a drive piston 1.2*a*, which can move back and forth in a drive cylinder 1.2*b* between two end positions, in particular two stops, preferably in the same direction of movement in which the diaphragm 4 of the diaphragm feed pump 1.1 coupled to the feed pump drive 8 can also move.

However, the effective surface of the drive piston 1.2*a* is selected to be barely, at most 20%, better at most only 10% larger, preferably the same or at least 10%, better at least 20%, smaller than that of the diaphragm 4, in order to make possible a compact design of the drive cylinder and thus of the entire pump unit.

The hydraulic cylinder 8 has a hydraulic connection 13 at least as shown on the pressure side of the drive piston 1.2*a* facing away from the diaphragm 4 and the feed pump 1.1 in the working chamber of the drive cylinder 1.2*b*. However, it will generally also have such a hydraulic connection on the other side of the drive piston 1.2*a*, the pull side, in order to be able to actively and thus more quickly pull the diaphragm 4 back from the inlet opening 5*a* and accelerate the filling of the feed pump 1.1. For this purpose, the two hydraulic connections 13 can be supplied from the same pressure medium source and selectively fed to one of the two working chambers of the hydraulic cylinder via a directional control valve 20.

The working chamber 1.1*b* of the feed pump 1.1 can also have a hydraulic connection in that it is preferably connected to the working chamber of the hydraulic pump remote from the diaphragm pump via a connecting line 19 and optionally a proportional valve 18.

A proportional valve 16 is preferably connected upstream of the, in particular each, hydraulic connection 13, which valve can be connected to the controller 1* of the pump unit 1 and can be controlled by it, as described above.

For this purpose, constant knowledge of the position of the drive piston 1.2*a* is essential, for which reason a position sensor 17 is arranged in the base of the drive cylinder 1.2*b*, preferably in the form of a distance sensor, which measures the distance of the drive piston 1.2*a* from the base of the cylinder 1.2*b* and reports it to the controller 1*. This sensor on the sensor cover (in the center at the bottom). This sensor measures the position of the piston via the conical surface in the piston.

The pump unit 1 preferably has a pressure connection 12 (pressure connection 12 in FIG. 1.1*b*), namely in the drive chamber 1.1*b* of the feed pump 1.1, whereby the filling process can be supported by applying negative pressure, especially if the storage container 101 from which the material M is removed is also under negative pressure. Of course, this only makes sense when this drive compartment 1.1*b* does not have a hydraulic connection.

A leakage sensor 15 is preferably arranged in the side of the diaphragm 3 facing away from the feed chamber 1.1*a*, the drive chamber 1.1*b*, which sensor detects material M that has penetrated there, which occurs at most in the event of a leak in the diaphragm 3 itself or in its circumferential clamping. As a rule, such a leakage sensor 15 is a liquid sensor, which however is also only useful when this drive chamber 1.1*b* of the feed pumps 1.1 does not have a hydraulic connection.

The drive piston 1.2*a* is connected to the diaphragm 3 via a drive plunger 9, which is arranged centrally, i.e. running along the axial direction 10, the direction of movement, and is attached to the diaphragm 3 on its rear side, i.e. the side of the drive chamber 1.1*b*.

There can preferably also be a pressure sensor 16 in this drive chamber 1.1*b*, which sensor can be in particular designed to be functionally combined with the leakage sensor.

The drive plunger 9 can be designed in multiple parts:

On the one hand, it comprises the shaft 9.1, which substantially bridges the distance from the drive piston 1.2*a* to the diaphragm 4, as well as a pressure plate 9.2, which is located at the end of the shaft 9.1 at the diaphragm side and abuts the diaphragm 4 with a large contact surface 9*a* (9.*a* is not shown in the drawing).

Viewed in cross-section, the diaphragm 4 has, in addition to the central region 4.2 which is continuous within the circumferential clamping of the in particular covered edge 4.1, an annular extension 4.4 to or in the drive chamber 1.1*b*, wherein the inner circumference of the extension 4.3 ends freely and its outer circumference is integrally connected to the rear side of the continuous main part 4.3 of the diaphragm, in particular to the central region 4.2.

In the intermediate space between the main part 4.3, continuous from one edge to the other, and the extension 4.4, there is a tension plate 9.3 which, on its rear side, has a centrally situated stem which protrudes through the opening of the extension 4.4 in the direction of the shaft 9.1 and is connected thereto, preferably screwed into it.

The tension plate 9.3 is used to be able to pull back the diaphragm 4 with a large engagement surface in the form of the extension 4.1 in the event of a rapid backward movement of the drive piston 1.2*a* caused by compressed air (the compressed air option for the backward movement needs to be described in more detail).

FIGS. 1*a* to *c* show the various functional positions of the drive piston 1.2*a* and of the diaphragm 4.

As can be seen, in the central position of the drive piston 1.2*a* according to FIG. 1*b* the diaphragm 4 is slightly curved at the center in the direction of the feed chamber 1.1*a* in the shape of a bulge 4B, and in the region between the outer diaphragm edge 4.1, tightly clamped in the pump housing 2, and the central region 4.2 which abuts the tension plate 9.3, it is slightly curved in cross-section in the direction of the drive chamber 1.1*b* in the shape of an annular bulge 4A, whereby a radial length reserve is formed for the two end positions:

When the drive piston 1.2*a* is at the end of the feed stroke, in particular abutting an axial stop of the feed pump housing 2 formed on the drive cylinder 1.2*b* as shown in FIG. 1*c*, this bulge 4A is pulled almost flat, and the diaphragm 4 almost reaches the inlet opening 5*a* and the outlet opening 6*a*, but not to the point of contact, in order to prevent damage to the diaphragm 4 by the edges of these openings.

In the other end position according to FIG. 1*a*, at the end of the filling stroke and the beginning of the feed stroke, i.e. when the feed chamber 1.1*a* is completely filled with material M and the piston 1.2*a* abuts another axial stop of the cylinder 1.2*b*, the diaphragm 4 lies with its central region further away from the inlet opening 5*a* and the outlet opening 6*a* than the edge 4.1 of the diaphragm 4, which is tightly clamped in the pump housing 2, so that in the radial region in between, the diaphragm 4 in particular is curved in the opposite direction to the curvature in the middle, central region, but is flatter than in the center position in FIG. 1*b*.

The inlet valve 5 and the outlet valve 6 in FIGS. 1*a-c* are designed as an active, i.e. driven, shut-off valve 14.

Instead of having an identical design to the inlet valve 5, the outlet valve 6 can also be designed as a simple non-return valve 7, as shown in FIG. 1*b*, in that, in this case, a ball, as the valve body 7.1, rests on the upward-facing valve seat 7.2 due to gravity when the same pressure prevails on both sides of the valve body 7.1, and of course even more so when a higher pressure is present on the side of the valve body 7.1 facing away from the valve seat 7.2 than on the other side.

For this reason, the outlet valve 6 should preferably be arranged with the valve seat 7.2 pointing upwards within the storage device 100 and preferably lying lower than the storage container 101 (a lower situation is not absolutely necessary).

This pump unit is used for the A2xx and not for the LP804.

FIG. 2 shows an overall storage device 100, into the frame of which the previously described pump unit 1 can be placed, in a vertical section along the generally upright longitudinal central axis 101', which is also the axis of symmetry of the substantially rotationally symmetrical storage container 101, comprising a pot 101.1, which can be closed tightly by a lid 101.2.

This pot is filled or can be refilled with material M via an inlet opening 103 and has one or two outlet openings 102 in the base 108, to each of which a pump unit 1 is connected with its inlet nozzle.

The at least one inlet opening 103 is here positioned in such a way that the material M falling downwards from it meets a truncated-conical drainage surface 110*a* of a drainage body 110 and flows downwards and radially outwards along it to its lower drip edge 109 in a thin layer, thereby degassing it.

Since the wall 107 of the pot 101.1 is not vertical, but is inclined radially upwards and outwards, and the drip edge 109 is located in the upper region of the storage container 101 near the inner surface 107*a* of the wall 107, the material M flows downwards from the drip edge 109 and meets the inner surface 107*a* of the wall 107, where it continues to run downwards as a thin layer and continues to degas.

The one or two pump units 1 are arranged so as to be situated horizontally with the diaphragm planes 3' of the feed pumps 1.1.

The storage container 101 is usually under negative pressure, in that in the lid 101.2, in addition to the inlet opening 103 there is also a negative pressure connection 104 which is coupled to a negative pressure pump 105. The interior of the storage container 101 is connected to the housing cavity of the feed pump 1.1 via a connecting line 113.

The storage container 101 often comprises a stirrer 106, which prevents sedimentation of heavy components of the material M by rotating around the longitudinal central axis 101'.

The motor 111 which drives the stirrer 106 is mounted on the upper side of the lid 101.2 and its motor-driven shaft 111*a* extends through this lid 101.2 in a sealed manner into the interior of the pot 101.1 and is connected to the upper ends of the stirrer blades 112*a,b* which rotate in the pot 101.1.

A rod-shaped fill-level sensor 114 extends upward from the base 108.

The drainage body 110 can be mounted in a stationary manner on the lid 101.2 or can be fastened to it so as to co-rotate with the stirrer 106, preferably at the upper region of the stirrer blades 112*a-c*.

Furthermore, a heating device 107 in the form of, for example, heating wires may be provided in the storage container 101, in particular in its wall, in order to heat the material M and thereby to thin it.

The controller 100* of the storage device 100 can also contain the controller 1* of the at least one pump unit 1.

LIST OF REFERENCE NUMBERS

1 Pump unit
1' Longitudinal central axis
1* Controller
1.1 Feed pump
1.1*a* Feed chamber
1.1*b* Drive chamber
1.2 Working cylinder unit, drive working cylinder
1.2A Drive cylinder
1.2B Drive piston
1.2*a* Working chamber
1.2*b* Working chamber
2 Feed pump housing
3 Pump element
4 Elastic element, diaphragm, feed diaphragm, bellows
4.1 Diaphragm edge
4.2 Central region
4.3 Continuous main part
4.4 Diaphragm extension
4*b* Drive side
4A, B Bulge, warping
4' Main plane
5 Inlet valve
5*a* Inlet opening
6 Outlet valve
6*a* Outlet opening
7 Non-return valve
7.1 Valve body
7.2 Valve seat
8 Feed pump drive
9 Drive plunger
9*a* Contact surface
9.1 Shaft
9.2 Pressure plate
9.3 Tension plate
10 Direction of movement, axial direction
11 Vertical
12 Pressure connection
13 Hydraulic connection
14 Shut-off valve
14*a* Valve body
14*b* Valve seat
15 Leak sensor
16 Pressure sensor
17 Position sensor
18 Proportional valve
19 Connecting line
20 Directional control valve
100 Storage device
100* Controller
101 Storage container
101' Longitudinal central axis
101.1 Pot
101.2 Lid
102 Outlet opening

103 Inlet opening
104 Negative pressure connection
105 Negative pressure pump
106 Stirrer
107 Wall
107*a* Inner surface
108 Base
109 Edge, drip edge
110 Drainage body
110' Axis of rotation
110*a* Drainage surface
111 Stirrer drive, motor
111*a* Motor shaft, driven shaft
112*a, b* Stirrer blade
113 Cross-strut
113.1 Central plate
114 Fill level sensor
115 Inlet valve
116 Window
117 Connection box
118 Vertical arm
119 Stirring plate
M Material
V Vertical

The invention claimed is:

1. Pump unit for conveying liquid or pasty material, wherein the pump unit comprises a feed pump which has:
a pump element which is movable relative to a feed pump housing in a direction of movement and which is or comprises an elastic element;
a feed pump drive in the form of a drive working cylinder which comprises a drive plunger movable in the direction of movement, which is operatively connected to the elastic element,
wherein:
the drive working cylinder can be operated hydraulically and at least one working chamber on a rear side of a drive piston facing away from the pump element has a hydraulic connection;
a drive chamber of the feed pump has a hydraulic connection configured to be pressurized during operation with the same pressure as the hydraulic connection of the at least one working chamber, and
a connecting line is provided between the at least one working chamber of the drive working cylinder facing away from the feed pump and the drive chamber of the feed pump.

2. Pump unit according to claim 1,
wherein the at least one working chamber on a front side of the drive piston facing the pump element has a hydraulic connection or a pneumatic connection.

3. Pump unit according to claim 1,
wherein the elastic element is a diaphragm, which is fixed with its outer edge tightly to inner sides of the feed pump housing.

4. Pump unit according to claim 1,
wherein an effective surface of the drive piston of the drive working cylinder is at most 20% larger than an effective surface of a diaphragm of the feed pump.

5. Pump unit according to claim 1,
wherein the elastic element is a bellows which connects the feed pump housing to a pump piston, and the feed pump is a bellows pump.

6. Pump unit according to claim 1,
wherein:
a position sensor is provided for ascertaining a position of the pump element or of the feed pump drive; and/or
a pressure sensor is arranged in a drive chamber of the feed pump.

7. Pump unit according to claim 1,
wherein a position sensor is designed as a distance sensor and is arranged on a rear side of the drive plunger facing away from the pump element and measures a position of the drive plunger and/or is arranged in a drive chamber of the feed pump and measures an axial position of the pump element.

8. Pump unit according to claim 1,
wherein:
a position sensor is a distance sensor which is arranged in a cylinder of the at least one working cylinder unit and;
either measures an axial distance to a rear end face of the drive plunger or of the drive piston of the drive working cylinder or measures a radial distance to a surface of the drive piston that is at an angle to an axial direction.

9. Pump unit according to claim 1,
wherein a controller is provided for controlling moving parts of the pump unit.

10. Pump unit according to claim 1,
wherein the feed pump housing has a heating device for heating an interior of the feed pump.

11. Pump unit according to claim 1,
wherein the feed pump has a leakage sensor which is capable of detecting a leak in the pump element.

12. Pump unit according claim 11,
wherein the leakage sensor is a liquid sensor on a drive side of a diaphragm or is a pressure sensor that detects a change in pressure on the drive side of the diaphragm.

13. Storage device comprising:
a storage container filled with liquid or pasty material;
at least one pump unit for emptying the storage container; and
a controller for controlling at least moving components of the at least one pump unit,
wherein the at least one pump unit is designed according to claim 1.

14. Storage device according to claim 13,
wherein the storage device comprises two pump units that can be operated and controlled independently of one another.

15. Storage device according to claim 13,
wherein a connecting line is provided between an air chamber of the storage container and a drive chamber of the feed pump.

16. Method for operating the pump unit according to claim 1, wherein the feed pump drive is operated hydraulically at least in a direction in which it moves the pump element in a discharge direction.

17. Method according to claim 16,
wherein the at least one working chamber comprises two working chambers and both working chambers of the drive working cylinder are alternately pressurized with pressure medium.

18. Method according to claim 16,
wherein an axial position of a movable monitored element of the pump unit is ascertained directly or indirectly.

19. Method according to claim 18,
wherein the axial position of the monitored element is determined over an entire movement path and a controller of the pump unit uses a position signal to provide a drive pressure that is defined for each axial position and/or a constant outlet pressure at an outlet opening of a feed chamber.

20. Method according to claim 16, wherein a drive chamber of the feed pump is pressurized with negative pressure.

21. Method according to claim 16, wherein an inlet valve is closed as soon as a position sensor signals that an end position of a diaphragm of the feed pump has been reached in a filling position.

22. Method according to claim 19, wherein the controller emits an alarm signal as soon as a leakage sensor in a drive chamber of the feed pump reports a leak.

23. Method according to claim 16, wherein the at least one working chamber of the feed pump is pressurized with hydraulic medium.

* * * * *